United States Patent [19]

Schneider

[11] 4,322,008

[45] Mar. 30, 1982

[54] DRINKING CONTAINER

[76] Inventor: Ira Schneider, 2520 Bouck Ave., Bronx, N.Y. 10469

[21] Appl. No.: 145,014

[22] Filed: Apr. 29, 1980

Related U.S. Application Data

[63] Continuation of Ser. No. 967,868, Dec. 8, 1978, abandoned.

[51] Int. Cl.[3] ..... A47G 19/22; B65D 23/00; B65D 25/00

[52] U.S. Cl. ..... 215/1 R; 220/85 R; 220/90.2

[58] Field of Search ..... 220/85 R, 90.2, 83.1 R, 220/1 BC, ; 229/1.5 B; D9/9, 13, 6; 215/1 R, 100 R

[56] References Cited

U.S. PATENT DOCUMENTS

| | | | |
|---|---|---|---|
| D. 87,606 | 8/1932 | Thomas | D7/9 |
| D. 186,535 | 11/1959 | Saffer | D7/9 |
| 195,337 | 9/1877 | Braunstein | 215/99.5 |
| D. 216,142 | 11/1969 | Gribbens | D7/13 X |
| 272,261 | 2/1883 | Jeffords | 220/70 X |
| 1,595,618 | 8/1926 | Redford | 215/1 R |
| 2,798,636 | 7/1957 | Ketchledge | 220/453 |
| 2,915,176 | 12/1959 | O'Neil | 229/1.5 B X |
| 3,252,803 | 5/1966 | Belasco | 206/217 X |
| 3,363,820 | 1/1968 | Schilling | 229/1.5 B |
| 3,434,588 | 3/1969 | Kirkpatrick | 220/83 X |
| 3,521,788 | 7/1970 | Kandel et al. | 229/1.5 B X |
| 3,674,512 | 7/1972 | Andros | 229/1.5 B X |

*Primary Examiner*—Allan N. Shoap

*Attorney, Agent, or Firm*—Lieberman, Rudolph & Nowak

[57] ABSTRACT

The present invention relates to a drinking container for increasing the number of and ostensibly decreasing the size of bubbles in a drinking liquid having dissolved gases contained therein. The container is provided with a roughened region on its normally smooth interior surface. The roughened region is preferably located at the bottom of the container and may be produced by grinding, sand blasting, acid etching, and the like. It is a feature of the disclosure that the roughened region may be formed of a separate element mechanically locked to the container.

2 Claims, 3 Drawing Figures

DRINKING CONTAINER

This is a continuation of copending, application Ser. No. 967,868, filed Dec. 8, 1978 abandoned.

BACKGROUND OF THE INVENTION

When a liquid containing a dissolved gas, such as beer is poured into a conventional drinking container, a foam or head is formed on the surface of the liquid by the sudden liberation of much of the dissolved gas. The size, texture, liveliness and longevity of such a head are often considered to be indicative of the quality of the liquid's taste; as is, the number and size of the bubbles themselves. Indeed, some people are so convinced of this relation between the characteristics of the head and the quality of beer's taste that they induce the formation of a head by dropping granules of salt into the liquid.

The foregoing is not mere superstition or wive's tale. I have found that there is a relationship between bubble size and number, and taste and that this relationship is direct, the greater the number of bubbles and the smaller their size, the mellower taste the beer as well as other carbonated beverages, including champagne, colas, uncolas, natural carbonated water, etc.

Naturally the inherent result of greater number of bubbles and smaller size is a bigger head on beer and greater effervesence of the other carbonated beverages.

Although it is not known with certainty why the mellower taste occurs, it is believed that the greater the number of bubbles of smaller size create a greater area surface interface within the liquid (volume to area ratios) and this greater area surface ratio produces the mellower taste of such beverages.

SUMMARY OF THE INVENTION

The present invention relates to an improvement over prior drinking containers whereby the structure of the drinking container induces the formation of a greater number of bubbles when a liquid having a dissolved gas is poured therein.

The improvement comprises the provision of a drinking container having a normally smooth interior surface with a roughened region on its interior surface. The roughened region is preferably located on the bottom of the container and may be produced by grinding, sand blasting, acid etching, and the like.

It is a feature of the invention that the roughened region may also be furnished as an adjunct to the container, i.e., as a mechnical attachable piece of roughened area.

The roughened surface when examined microscopically creates a substantial increase in the interior surface area of the glass (and even a half-dollar size roughening in an 8 ounce glass will almost double the interior surface area) and second, a vast number of peaks or mountaintops which serve as nucleating centers for bubble formation.

STATEMENT OF THE OBJECTS OF THE INVENTION

Accordingly, the object of the invention is to provide a modified container surface which improves the taste of drinks having dissolved gases therein.

It is a further object of this invention to satisfy the first object by inducing a greater number of bubbles of smaller size.

It is a further object of this invention to satisfy the foregoing objects at minimal cost with an arrangement which works as well with a variety of containers, including glass, porcelain, plastic, ceramic, china, and metal, and in general almost any smooth surface permanent glass.

It is a still further object of the invention to provide in a mechanical adjunct for existing containers which will modify such containers so as to satisfy the inventive objects.

BRIEF DESCRIPTION OF THE DRAWINGS

A more complete understanding of the present invention, and many of the attendant advantages thereof, will be apparent from the following detailed description when considered in conjunction with the accompanying drawings, wherein.

DESCRIPTION OF THE PREFERRED EMBODIMENTS

Figure 1:
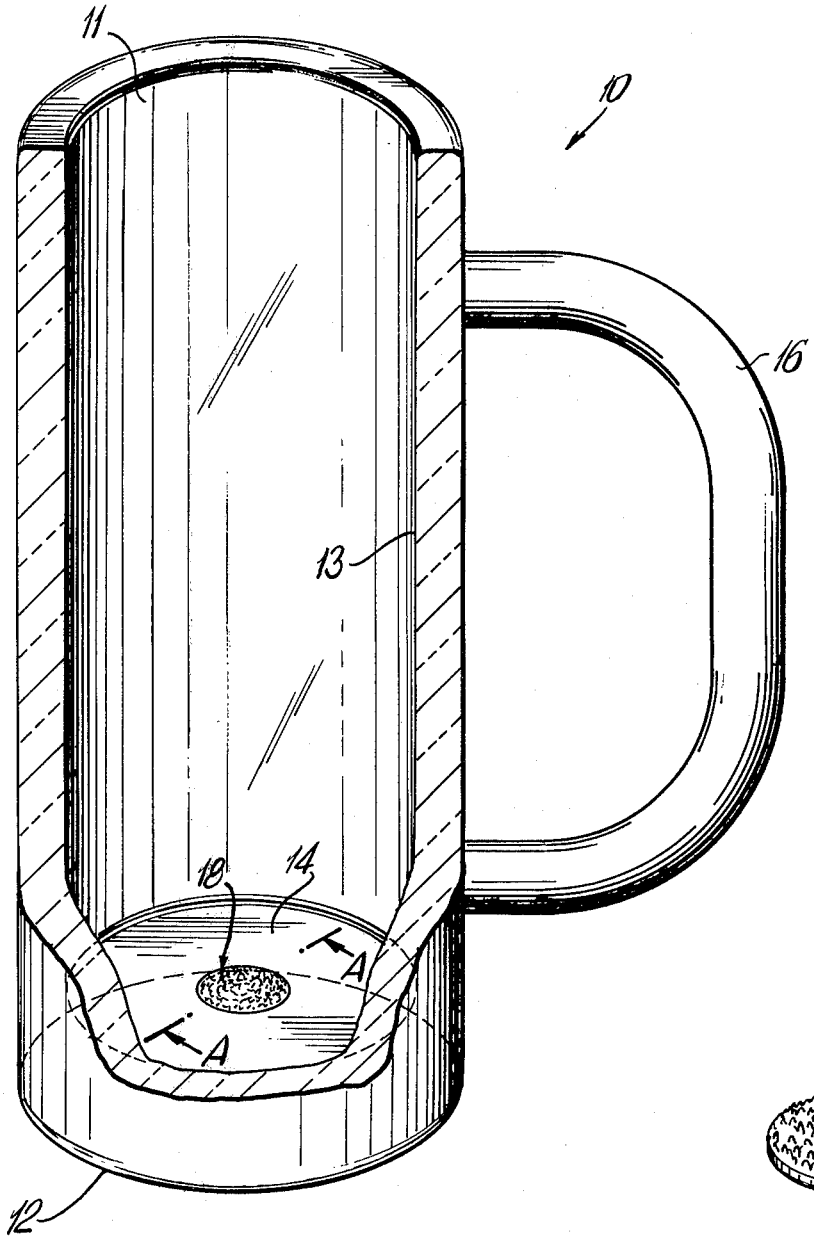
FIG. 1 is a perspective view, partly in section, of a drinking container of my invention.

Referring now to the drawings where like reference numerals refer to the same item, there is shown in FIG. 1 a drinking container 10. While the drinking container 10 is shown as a mug, it should be understood that the drinking container of the present invention is not limited to a mug, but may also be a cup, bottle, can or the like. Furthermore, the drinking container 10 may be fashioned of metal, plastics, ceramics, glass, and the like. For ease of explanation with a suitable familiar drink, the invention shall be described with reference to beer, where the head formation and longevity are an obvious manifestation of bubble quantity. It will be appreciated however that such description is only applicable to one use of the invention, which as previously stated is broadly applicable to drinks having dissolved gases therein.

The drinking container 10 is of the normal mug shape having a handle 16 with an open end 11 into which liquid is poured and a base 12 open at the container normally rests thereby defining a cavity having an internal surface 13.

Although the container cavity may be fashioned in any shape, this invention is directed solely to the interior surface 13 thereof into which the liquid may be poured and the modification to be described will preferably be applied to the interior bottom of the container so that is where the liquid is first received and last remains during use. However, as will be appreciated it may also be applied to the sides or from the bottom up the sides.

A conventional drinking container has a normally smooth interior surface, however, the present invention contemplates roughening a portion of the interior surface to form a roughened region 18 of the interior surface. The roughened region 18 may be formed by grinding, sand blasting, acid etching or the like, with the preferred method of roughening being somewhat dependent upon the container material, the cavity shape, and the desired size and relief of the roughened region 18.

Figure 2:
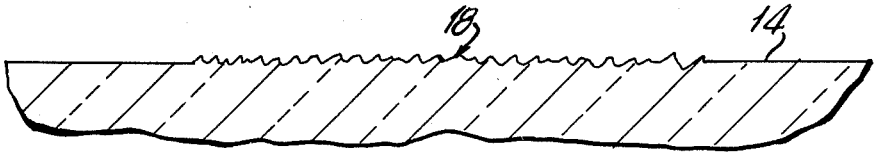
FIG. 2 is a diagrammatic sectional view of the roughened region substantially taken along line A—A of FIG. 1.

As is illustrated by FIG. 2, the interior surface in the roughened region 18 comprises a plurality of peaks and valleys that increases the interior surface area without substantially varying the volume of the cavity. The peaks and valleys may be randomly dispersed, or they may be arranged in a sequence or pattern, depending upon what method of roughening is used. Furthermore, the relative steepness of the peaks and valleys and the interpeak spacing may be varied, also depending upon the selected roughening method. FIG. 1 shows only one roughened region 18 on the interior surface of the container 10, but it should be clear that a plurality of such roughened regions could also be included.

When a beer contacts the roughened region 18, much of the dissolved gas is liberated and bubbles to the surface where it produces a foam or head. The precise theory by which the roughened region 18 causes this liberation or degassing is unknown, but it is believed that the peaks within the roughened region 18 provides nucleating points for the dissolved gas. Even after the liquid initially contacts the roughened region 18, gas liberation will occur around the roughened region 18. The provision of such a roughened region in a drinking container thereby induces the formation of a head on the surface of the liquid and contributes to its longevity.

It should be apparent that although the roughened region 18 could be located anywhere on the interior surface, it is preferably located on the bottom 14, since the bottom 14 contacts the liquid longest.

For beer, it has been found that assuming the container size to be between 6 and 12 ozs., the roughened surface area 18 is preferably coin size, i.e., between 1 and 3 centimeters in diameter.

The preferred area or size of the roughened region 18 depends upon many factors such as the volume and shape of the cavity, the method of roughening, and the characteristics of the liquid and of the dissolved gas. It has been found that a sand blasted roughened region approximately 2 centimeters in diameter is preferred for a conventional container having a cavity volume of approximately one-third liter for common, bottled beer and a glass mug.

Because of the great variety of containers and liquids having dissolved gases therein, the invention has not been described except by example of beer and glass. Possible permutations and combinations of different carbonated beverages with different containers which will be appreciated runs into the thousands, however the following describes how, with simple ministerial experimentation a container may be specifically adapted to a particular liquid.

It has been found that the finer the etching process (acid is finer than sand blasting, which is finer in turn than grinding) the number of nucleator center areas will be increased with finer processes and therefore the area of roughening may be decreased for the same result. Further, it has been found that increasing the roughened surface area as a ratio to the overall interior surface beyond a certain point is counter-productive. Thus, for example, when over half the interior glass area is roughened, in the case of beer, beer poured in will immediately head up and foam out of the container and indeed it is almost impossible to keep beer in a mug where 75% of the interior surface area has been roughened. Most beneficial for the common dissolved gas in drinks is a surface area of between 1% to 15% of the internal surface area of the container with the roughened surface area at the bottom. The type of roughening process employed is largely one of economics and is generally dictated by the process for manufacturing the container itself, i.e., a roughened process which may be applied "in line" with the manufacture of the container.

Figure 3:
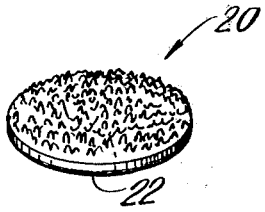
FIG. 3 shows a coin size attachment for the bottom of a container.

FIG. 3 shows an alternative embodiment in the invention in which the roughened region surface area may be applied by the container owner subsequent to manufacturing. In this case the roughened surface area is provided by a disc 20 of almost any size and shape, the area of which may be empirically determined as set forth above which is preferably between 1 and 3 centimeters in diameter. Any method of attachment may be provided for discs, such as a contact adhesive back 22 as shown in the drawing, with the disc conventionally being provided with a peel-off waxpaper, and the adhesive being generally of the water and soluble type.

As will be appreciated by the reader any method of attachment of the disc will suffice, as will an etched glass disc on a plastic container and vice versa. In general, there has been found no necessary relationship between the type of container and the type of disc and any one of the glass, ceramic, porcelain, plastic, china or metal containers may be used with any one of the glass, ceramic, porcelain, plastic, china or metal discs.

It will be clear to those skilled in the art that modifications and variations of the above-described preferred embodiments may be made without departing from the spirit and the scope of my invention. Consequently, my invention, as claimed below, may be practiced otherwise than as specifically described above.

What is claimed is:

1. A drinking container for improving the drinking quality of beverages having dissolved gases, comprising means for inducing the release of the carbonation contained within said beverage, said means comprising a roughened surface area on the interior surface of said container, said roughened surface area being produced by a process selected from the group consisting of acid etching, sand blasting, and grinding, said roughened surface area being not less than 1%, nor more than 50%, of the interior surface area of said container, said roughened area substantially increasing the interior surface area of said container while maintaining relatively constant the interior volume of said container, said drinking container being between 6 and 12 ozs. and the roughened surface area being located at the bottom of said container and being between 1 and 3 centimeters in diameter or the equivalent in area.

2. A drinking container for improving the drinking quality of beverages having dissolved gases, comprising means for inducing the release of the carbonation contained within said beverage, said means comprising a roughened surface area on the interior surface of said container, said roughened surface area being produced by a process selected from the group consisting of acid etching, sand blasting, and grinding, said roughened surface area being not less than 1%, nor more than 50%, of the interior surface area of said container, said roughened area substantially increasing the interior surface area of said container while maintaining relatively constant the interior volume of said container, said roughened region being formed on a separate element and means for mechanically locking said element to the interior surface of said container.

* * * * *